US007252536B2

(12) United States Patent
Lazaro, Jr. et al.

(10) Patent No.: US 7,252,536 B2
(45) Date of Patent: Aug. 7, 2007

(54) SELF-ALIGNING VIBRATION RESISTANT COUPLING APPARATUS

(75) Inventors: Luis J. Lazaro, Jr., Shoreline, WA (US); Brian W. Graebel, Everett, WA (US)

(73) Assignee: The Boeing Company, Chicago, IL (US)

( * ) Notice: Subject to any disclaimer, the term of this patent is extended or adjusted under 35 U.S.C. 154(b) by 31 days.

(21) Appl. No.: 11/164,450

(22) Filed: Nov. 22, 2005

(65) Prior Publication Data

US 2007/0117448 A1 May 24, 2007

(51) Int. Cl.
*H01R 13/58* (2006.01)

(52) U.S. Cl. ..... 439/470; 439/905

(58) Field of Classification Search ..... 439/449, 439/320, 321, 328, 450, 609, 680, 677, 681, 439/470, 905

See application file for complete search history.

(56) References Cited

U.S. PATENT DOCUMENTS 4,423,919 A * 1/1984 Hillis ..... 439/609
5,468,161 A * 11/1995 Wright ..... 439/610
5,807,138 A * 9/1998 Guiol ..... 439/610
6,095,828 A * 8/2000 Burland ..... 439/98
6,375,509 B2 * 4/2002 Mountford ..... 439/610

* cited by examiner

*Primary Examiner*—Tho D. Ta
*Assistant Examiner*—Vanessa Girardi
(74) *Attorney, Agent, or Firm*—Felix L. Fischer

(57) ABSTRACT

A self-aligning coupling apparatus incorporates a first connecting element having a body with a first set of accessory teeth and a second connecting element having a body and a second set of accessory teeth for engagement of the first set. A coupling ring joins the first and second element. The first set of accessory teeth includes spaced indexing teeth having an apex angle less than an apex angle of the remaining teeth of the first set and a height greater than the remaining teeth of the first set. The second set of accessory teeth is has an apex angle complementing the apex angle of the remaining teeth of the first set. The second set of accessory teeth have canals intermediate the teeth to receive the indexing teeth upon joining of the first and second element by the interconnecting coupling.

18 Claims, 8 Drawing Sheets

SELF-ALIGNING VIBRATION RESISTANT COUPLING APPARATUS

BACKGROUND OF THE INVENTION

1. Field of the Invention

The present invention relates to electrical connector strain relief mechanisms and more particularly to the use of indexing teeth for positive engagement between accessory teeth in a connector and a strain relief cable clamp employing an coupling ring with self locking engagement mechanisms.

2. Description of the Related Art

The assembly of a strain relief cable clamp or "backshell" which has a self-locking mechanism (for vibration resistance properties) and rear accessory teeth as defined in Military standard MS3155 onto an electrical connector having the same MS3155 accessory teeth can result in binding which precludes proper assembly of the backshell and connector. The backshell includes a self locking device which consists of two arch shaped spring fingers, each having a detent positioned at opposite ends of the arch. The two spring fingers are installed longitudinally and circumferenctially across from each other in a formed 360° slot on the interior surface of the coupling ring. The backshell body includes accessory teeth on its proximal end and spaced serrations with predetermined spacing on the circumferential periphery of the body located at the root of the teeth to engage the self locking devices. The coupling ring is provided with three inspection holes spaced at 120° around its periphery. The accessory teeth on the electrical connector are positioned on the shell or body opposite the connector engagement face.

When the backshell is coupled onto an electrical connector, the self-aligning movement or coupling of the two components is impeded when both sets of accessory teeth are at a peak-to-peak condition which often results in "binding", creating a false coupled backshell and connector. This condition exists when the spring fingers detents on the self-locking devices on the backshell are locked onto the serrations without proper seating of the accessory teeth. In this condition, the approximately 0.035 to 0.04 radius on the peak of each interfacing tooth coupled with the large number of accessory teeth prevents any sliding action from occurring. The number of teeth can be from a minimum of twelve (12) to a maximum of fifty four (54). Applying torque to the backshell will not resolve the "binding" condition and the interfacing accessory teeth are not engaged or coupled. Therefore, the backshell is physically loose negating the desired vibration resistant properties which are non-existent without a complete mating interface of the accessory teeth. This condition often directly leads to finding non-compliance on the bonding and grounding requirements in complex systems such as aircraft.

It is therefore desirable to provide an arrangement to eliminate the problematic peak-to-peak condition during assembly of the strain relief cable clamp onto an electrical connector. It is further desirable to ensure that the Electro-Magnetic Interference/Radio Frequency Interference (EMI/RFI) performance of the backshell is not compromised or dependent on its assembly process onto the electrical connector. Additionally, it is desirable to allow self-locking devices on the backshell to not interfere with the coupling or engagement of the interfacing accessory teeth between backshell and electrical connector. It is still further desirable to eliminate the need for the inspection holes on the backshell coupling ring.

To better understand the embodiment of the invention disclosed herein, FIG. 1*a* discloses a prior art electrical connector 10 and strain relief cable clamp or backshell 12 with MS3155 accessory teeth. The backshell incorporates a coupling ring 14 having with self-locking devices 16 shown in detail in FIG. 1*b*. For the embodiment shown, the connector and clamp arrangements, the backshell self-locking devices consist of two arch shaped spring fingers each with a detent 18 positioned at its opposite ends. The two spring fingers are installed longitudinally and circumferentially across each other within a formed 360° slot 20 on the interior face of the coupling ring. The detents of the locking devices are received in serrations 22 on the circumference of the backshell as best seen in FIG. 1*c*. The serrations are spaced to receive the detents when the coupling ring slides over body 24 of the backshell during assembly. FIG. 2*b* shows the connector and backshell in partial engagement with the coupling ring engaging threads on the connector back body. Non-engagement of the interfacing accessory teeth 26 and 28 between the electrical connector and backshell is created by engagement of the self-locking devices in the serrations on the coupling ring of the backshell with the accessory teeth of the connector and backshell in a peak-to-peak condition as shown in detail in FIG. 2*b*. During coupling when accessory teeth 26 and 28 are at a peak-to-peak condition as shown 'binding' will likely occur, creating a condition of a false coupled electrical connector and backshell. A prior art solution to this problem is to examine the accessory teeth through an inspection hole 30 in the backshell coupling ring (as seen in FIG. 1*a*) and if a peak-to-peak condition is identified, rock the backshell back and forth to dislodge the interfacing accessory teeth from the peak-to-peak condition. This process might be repeated several times until the accessory teeth are fully engaged or coupled. As described, the process is laborious, tedious and failure prone.

SUMMARY OF THE INVENTION

A self-aligning coupling apparatus employing the present invention incorporates a first connecting element having a body with a first set of accessory teeth and a second connecting element having a body with a second set of accessory teeth for engagement of the first set and a coupling ring which joins the first and second element. The first set of accessory teeth includes at least one indexing tooth having an apex angle less than an apex angle of the remaining teeth of the first set, the at least one indexing tooth further has a height greater than the remaining teeth of the first set. The second set of accessory teeth is equal in number to the first set and has an apex angle complementing the apex angle of the remaining teeth of the first set. The second set of accessory teeth have canals intermediate the teeth to receive the at least one indexing tooth upon joining of the first and second element by the interconnecting coupling.

In exemplary embodiments, the first set of accessory teeth incorporates two or three indexing teeth spaced around the circumference of the first connecting element body. The indexing teeth have an apex angle of approximately 30° and are significantly longer than the remaining accessory teeth in the set.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 3A:
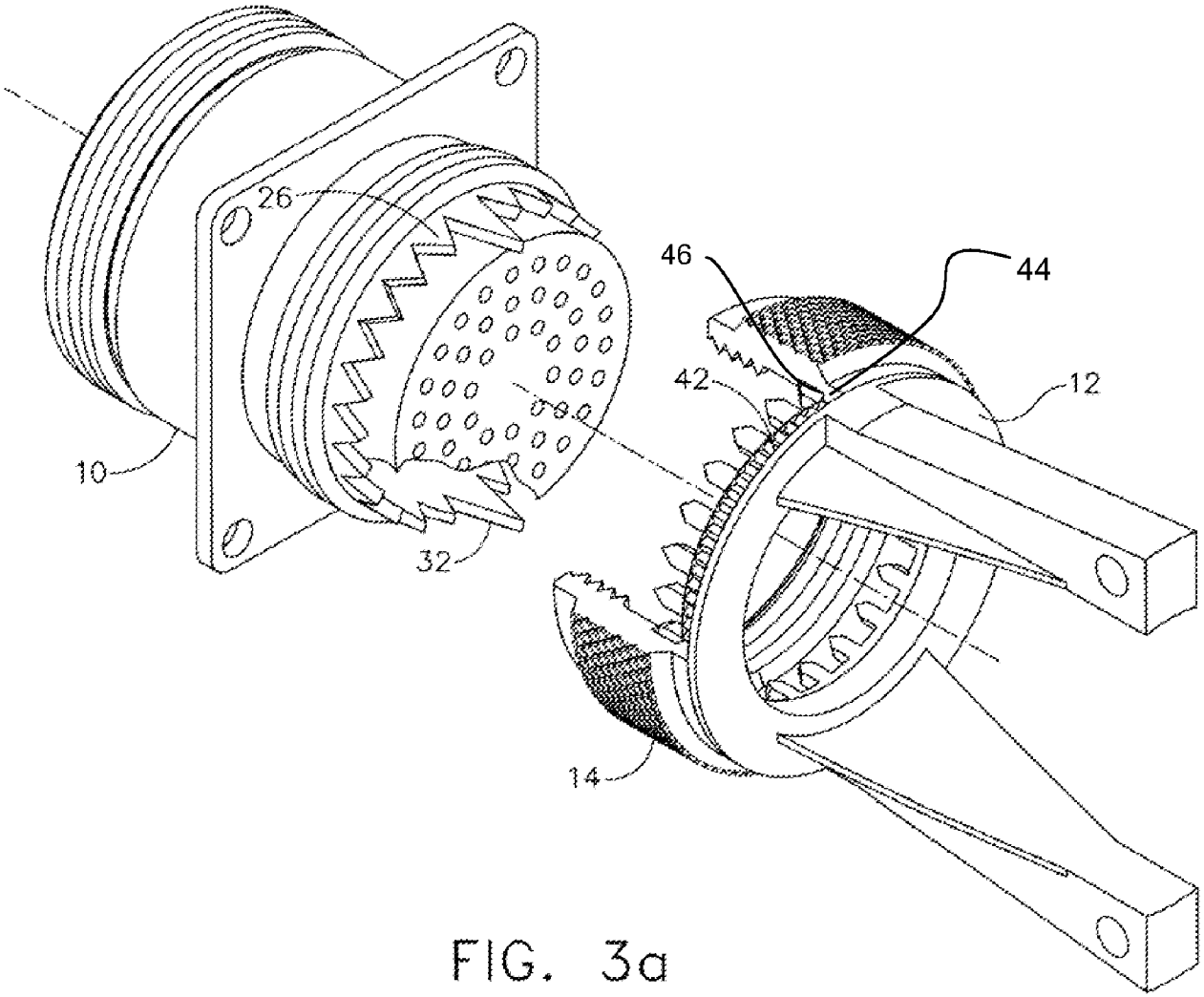
FIG. 3*a* is a perspective partial sectional view of the modified accessory teeth of a first embodiment of the present invention.
Figure 3C:
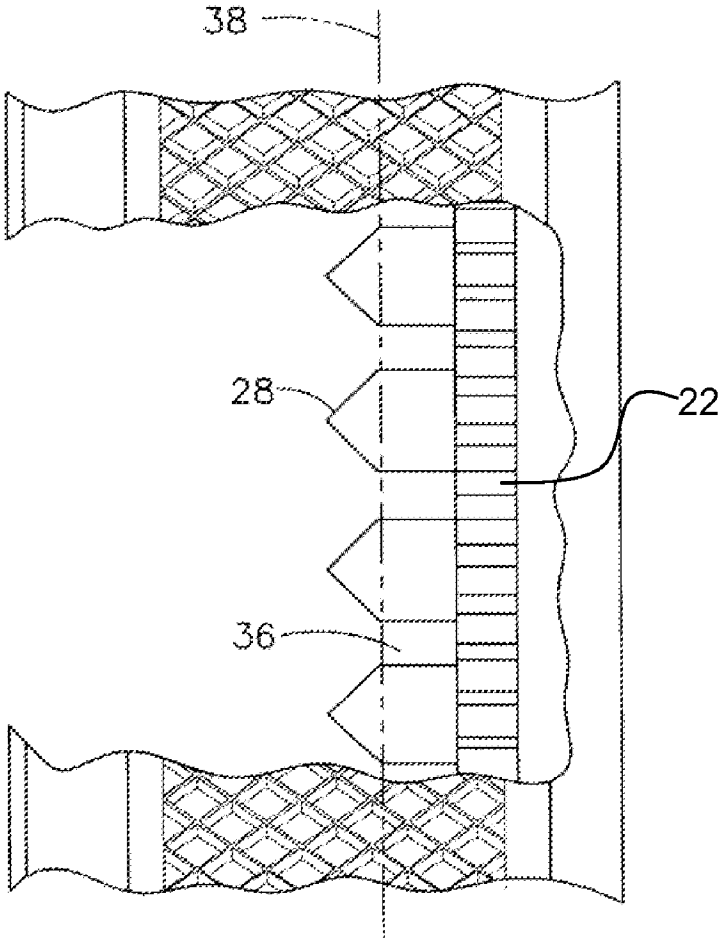
FIG. 3*c* is a detailed side view showing the canal located at the root of each tooth on the backshell accessory teeth, the locking elements shown in FIG. 1*b* have been eliminated for clarity in the drawing.
Figure 3B:
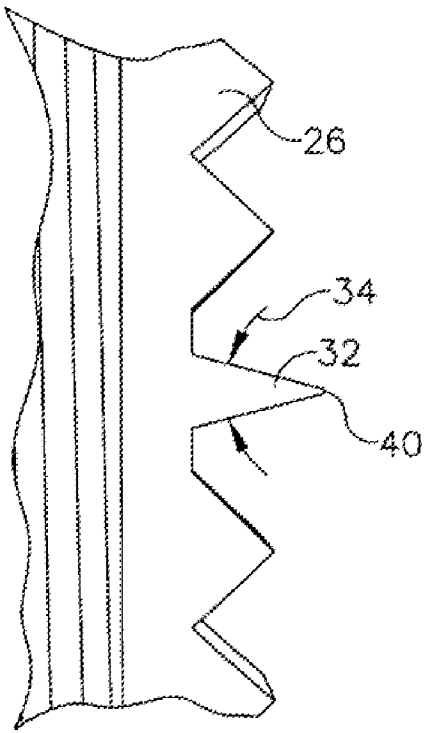
FIG. 3*b* is a detailed side section view showing one of two indexing accessory teeth 180° apart on the connector have a 30° internal angle on the triangular shaped tooth and an 0.01 to 0.015 tooth peak radius on both backshell and connector accessory teeth.

An exemplary embodiment of the invention is shown in FIG. 3*a* wherein two or three extended indexing teeth 32 shown in detail in FIG. 3*b* are located 180° or 120° apart, respectively, across the circumference of the connector having a 30° apex angle 34 in an isosceles triangular shaped tooth on the electrical connector. For the embodiment shown, the length of the indexing teeth is approximately 0.063 to 0.070 inch shown by numeral 9 in FIG. 4*b* while the accessory teeth have a normal dimension of approximately 0.041 to 0.051 inch as shown by numeral 15 in FIG. 4*b*. The interfacing accessory teeth on the backshell incorporate intermediate canals 36 at the root area 38 of the MS3155 accessory teeth as shown in FIG. 3*c*. Additionally, the peak of the accessory teeth on both the connector and backshell have a significantly reduced radius 40 from the prior art which for the embodiment shown is approximately 0.01-0.015 inch. For the embodiment shown, the apex radius for the indexing teeth is also approximately 0.010 to 0.015 inch.

Figure 1A:
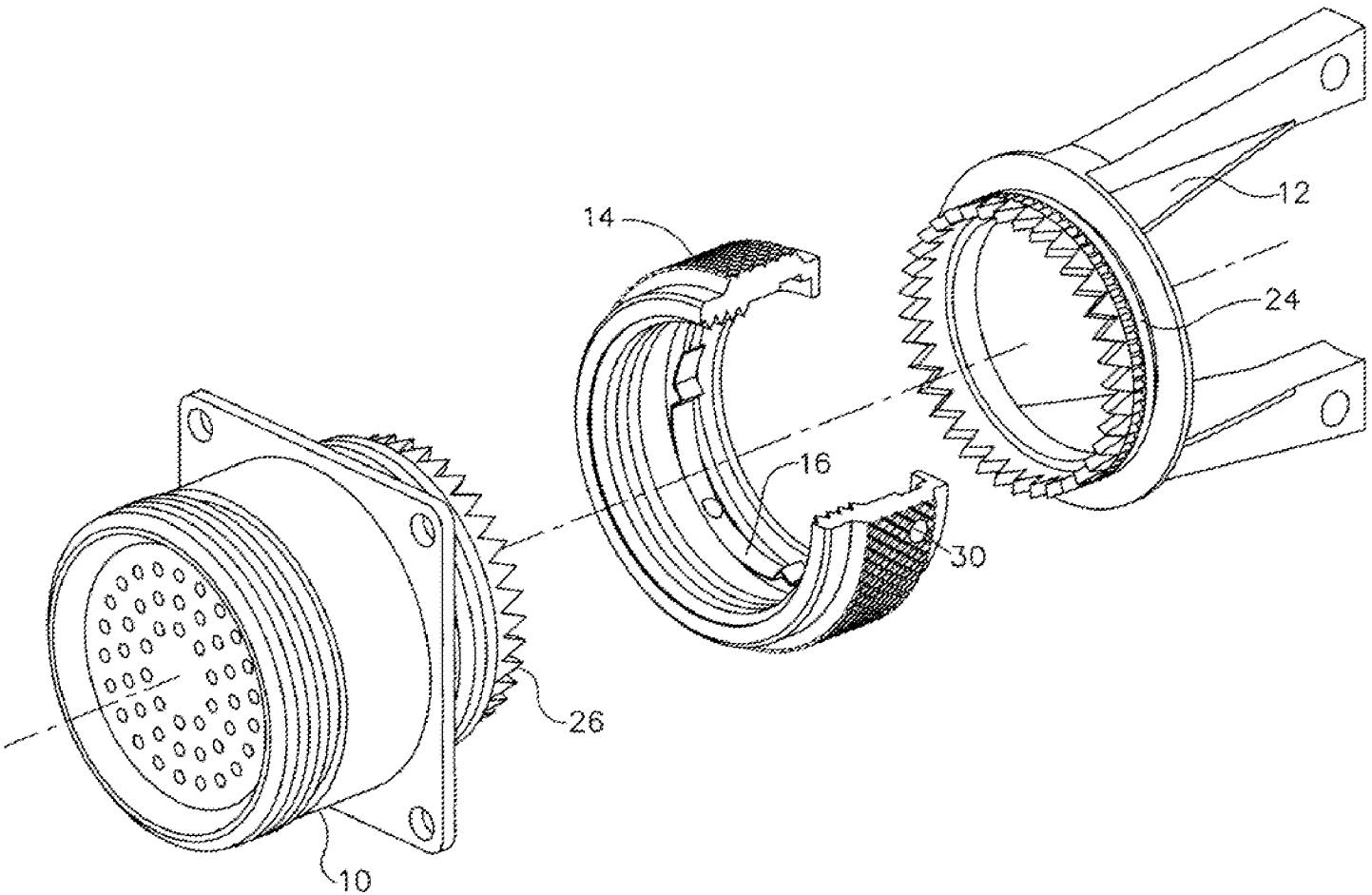
FIG. 1a PRIOR ART
FIG. 1*a* is an exploded perspective view, made in accordance with prior art, depicting self-locking, strain relief cable clamp or backshell and electrical connector having MS3155 accessory teeth.
Figure 1C:
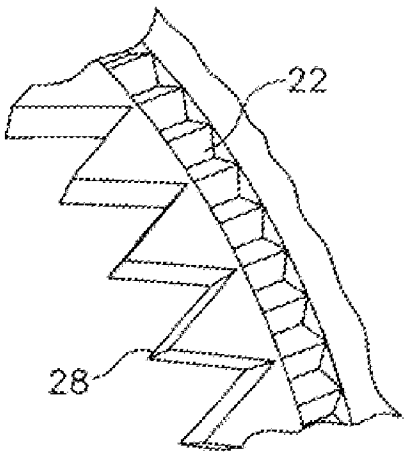
FIG. 1c PRIOR ART
FIG. 1*c* is a detailed view of the serrations and accessory teeth of the backshell.
Figure 1B:
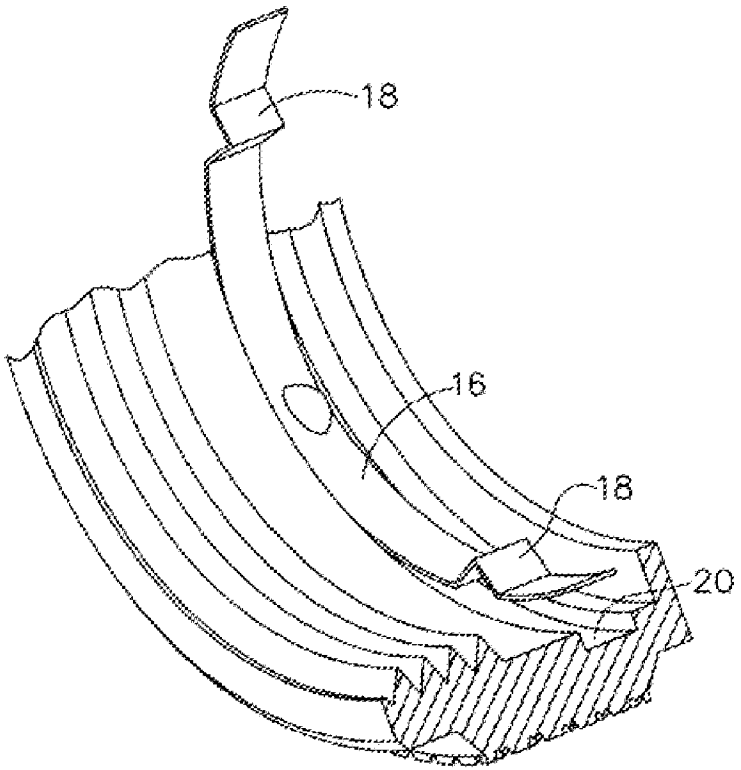
FIG. 1*b* is a detailed view of the self-locking elements of the assembly of FIG. 1*a* which are also employed in the present invention.
Figure 2A:
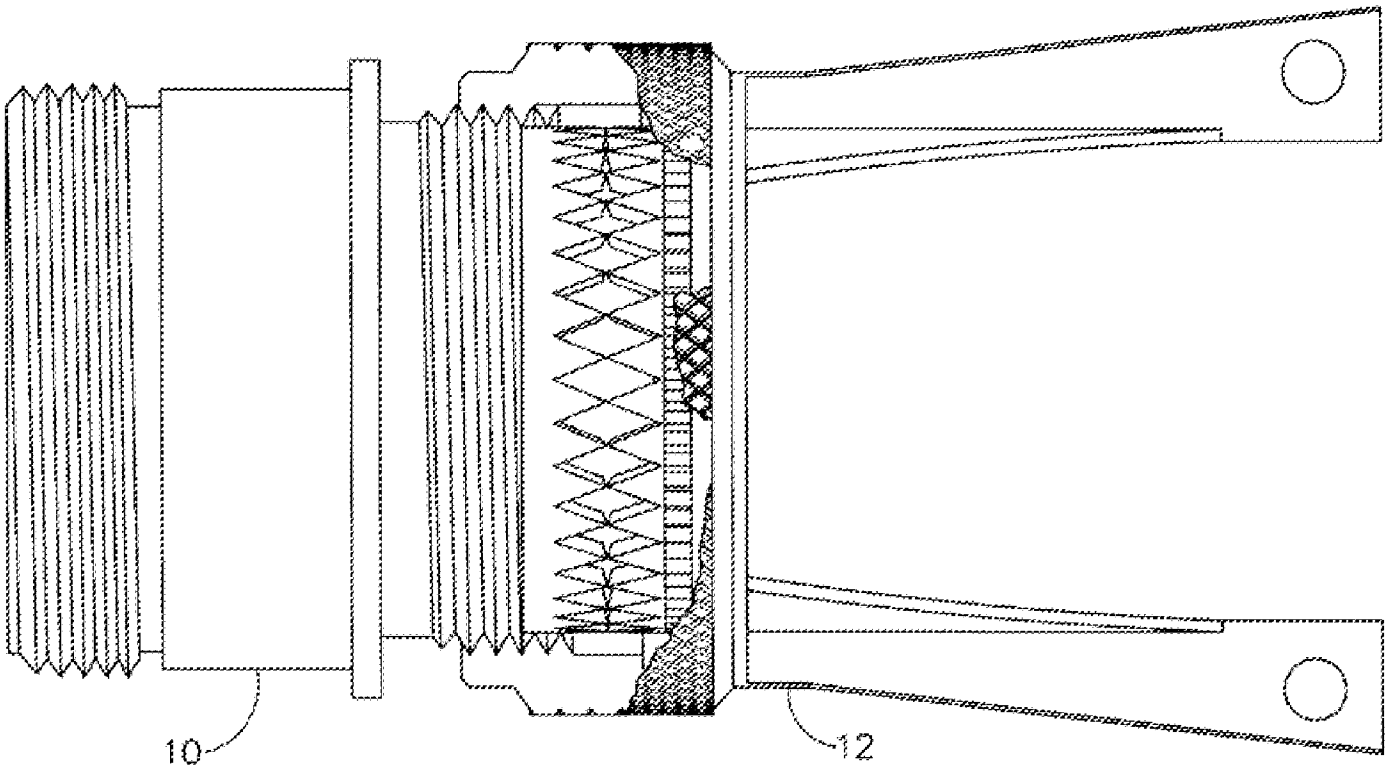
FIG. 2a PRIOR ART
FIG. 2*a* is a side sectional view of the assembled backshell and electrical connector illustrating the peak-to-peak accessory teeth engagement.
Figure 2B:
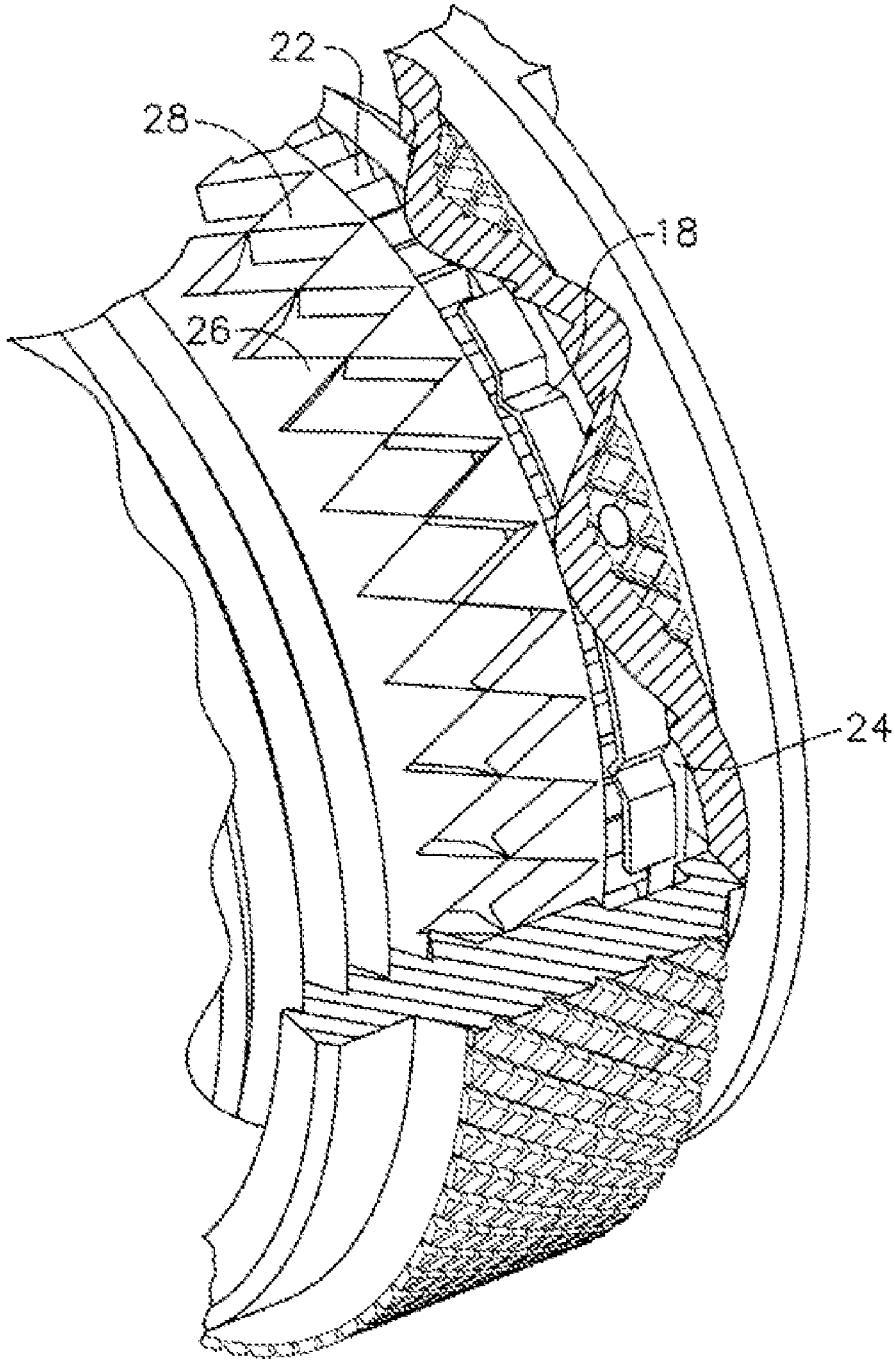
FIG. 2b PRIOR ART
FIG. 2*b* is a detailed perspective sectional view of the self-locking devices with the spring fingers detent locked in the receiving serrations.
Figure 4A:
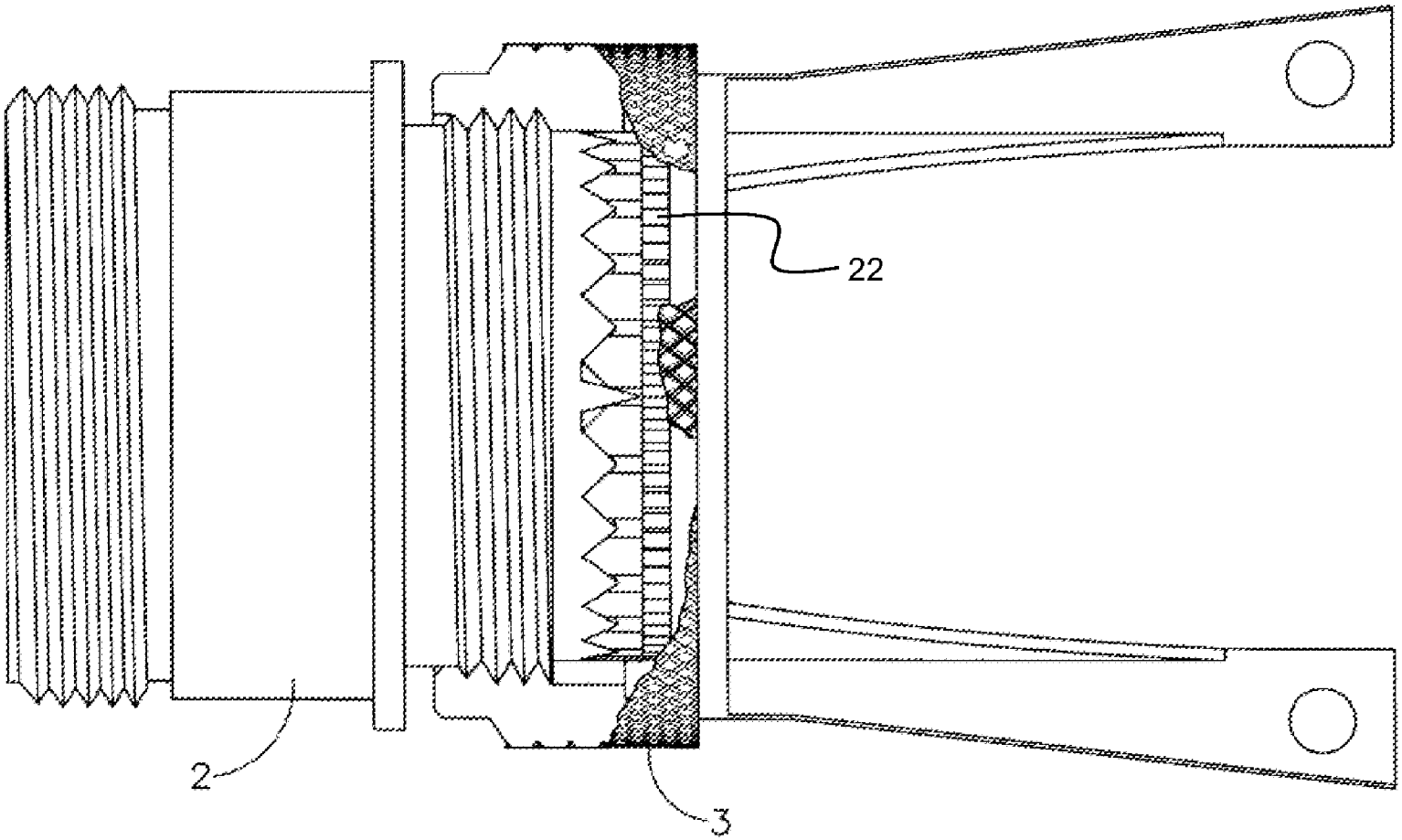
FIG. 4*a* is a sectional side view of a properly coupled electrical connector and backshell employing the present invention.
Figure 4B:
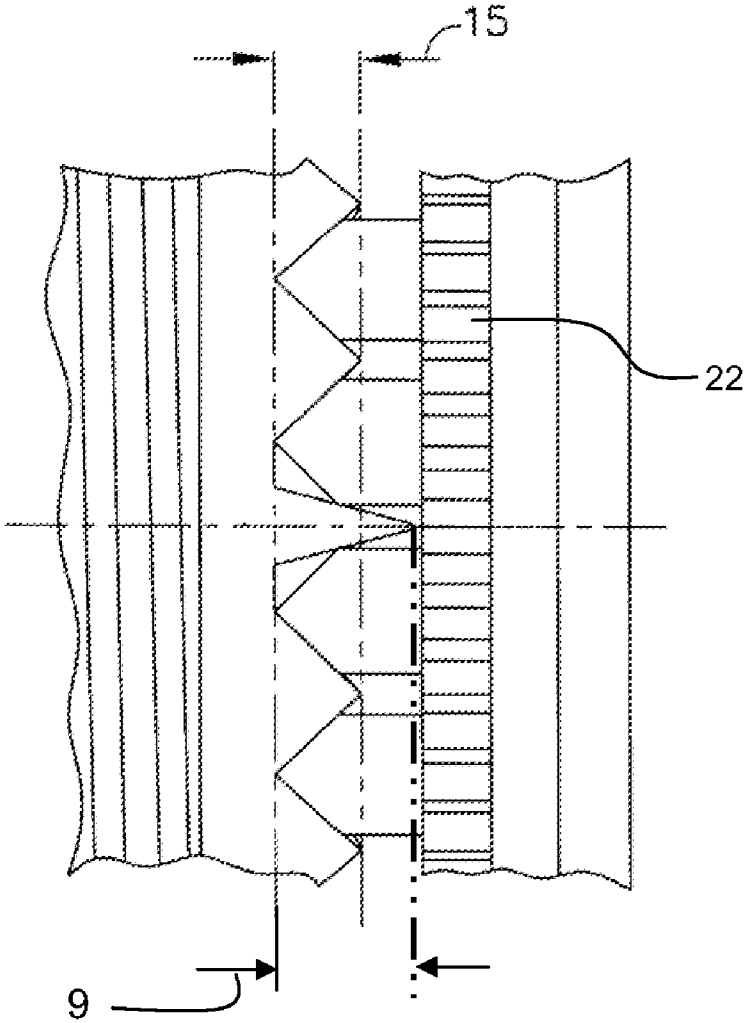
FIG. 4*b* is a magnified partial view of the details of the engagement of the accessory teeth with the indexing tooth received in a canal.

To better understand the overall assembly and demonstrate the effectiveness of the modified MS3155 accessory teeth, the following detailed explanation of the coupling action between electrical connector 10 and backshell 12 is provided. With reference to FIG. 4*a*, the internal thread of backshell coupling ring 14 engages the external thread of electrical connector 10 and a shoulder 42 on the body of the backshell and with each clockwise rotational movement pulls the interfacing accessory teeth 26 and 28 toward each other. Having initial contact created by only two or three indexing teeth 32 instead of the full compliment of the accessory teeth which depending on the electrical connector and backshell shell size may number 12 to 54 in various configurations, lessens the number of teeth potentially at the previously described peak-to-peak condition. Additionally, the higher contact angle created by the 30° apex angle in the indexing teeth and the smaller radius on the accessory teeth reduces the potential for binding of an indexing tooth on an opposing accessory tooth and deflects the indexing teeth from the apex of the opposing accessory teeth into the adjacent canals. Thus the rotational force being applied at the backshell coupling ring overcomes the 'binding' between any peak-to-peak index teeth and opposing accessory teeth and the slipping interface between the initially contacting indexing teeth the opposing accessory teeth causes a relative rotation between the connector and the backshell enhancing self alignment of the sets of accessory teeth. Also, it is understood the 0.01-0.015 in radius at the peak of the accessory teeth enhances the sliding action between interfacing teeth allowing accessory teeth 26 and 28 to bottom as shown in FIG. 4*b*. When the connector and backshell engagement reaches bottom, canals 36 at the backshell end receive the indexing teeth on the electrical connector end enabling all other teeth to be "metal-to-metal" or fully coupled. As shown in FIG. 3*a*, shoulder 44 on the coupling ring engages lip 46 on the backshell for conversion of the rotational thread motion to axial displacement. The detents of the spring locking fingers, shown in FIG. 1*b*, are received in serrations 22 on the circumference of the backshell. For the embodiment shown, the indexing teeth reside on the connector set of accessory teeth while in alternate embodiments the indexing teeth reside in the set of accessory teeth on the backshell.

The assured engagement of the accessory teeth allows the elimination of the three inspection holes which perforate the "backshell coupling ring and can be a source for fluids, grime/dust, etc. to enter the mated connector and backshell. Eliminating the perforations avoids the corrosion/contamination that will significantly degrade the Electromagnetic Interference/Radio Frequency Interference (EMI/RFI) integrity required by applications in which the presently disclosed invention may be employed such as aircraft systems. An unperforated ring is therefore highly desirable. It should be noted that the backshell assembly onto an electrical connector is now a single performance functionality with respect to modern aircraft quality inspection. It is understood that bonding and grounding is accomplished through the shielded cable to the backshell to the electrical connector to the airplane structure in an aircraft application. The EME requirement has become more stringent and critical on newer airplanes. The present invention therefore provides lower assembly and repair cost for aircraft and other complex systems.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A self-aligning coupling apparatus comprising:

a first connecting element having a body with a first plurality of accessory teeth;

a second connecting element having a body with a second plurality of accessory teeth;

an interconnecting coupling joining the first and second element;

said first plurality of accessory teeth including at least one indexing tooth having an apex angle less than an apex angle of the remaining teeth of the first plurality, the at least one indexing tooth further having a height greater than the remaining teeth of the first plurality;

said second plurality of accessory teeth equal in number to the first plurality and having an apex angle complementing the apex angle of the remaining teeth of the first plurality and having means intermediate the teeth to receive the at least one indexing tooth upon joining of the first and second element by the interconnecting coupling.

2. A coupling apparatus as defined in claim 1 wherein said first plurality of accessory teeth includes two indexing teeth spaced at 180 degrees.

3. A coupling apparatus as defined in claim 1 wherein said first plurality of accessory teeth includes three indexing teeth spaced at 120 degrees.

4. A coupling apparatus as defined in claim 1 wherein the receiving means comprises a plurality of canals intermediate each adjacent pair of the second plurality of accessory teeth.

5. A coupling apparatus as defined in claim 4 wherein the canals are substantially rectangular in shape.

6. A coupling apparatus as defined in claim 1 further comprising;

locking means supported by the interconnecting coupling; and means on the body of said second connecting element for receiving the locking means.

7. A coupling apparatus as defined in claim 6 wherein the locking means comprises arcuate spring fingers received in a groove on an internal surface of the interconnecting coupling, said spring fingers having at least one detent extending therefrom, and said means for receiving the locking means comprises a plurality of serrations at predetermined spacing on the external circumference of the body of the second coupling adjacent the second plurality of accessory teeth.

8. A coupling apparatus as defined in claim 6 wherein the at least one indexing tooth engages an oppositely adjacent one of the accessory teeth prior to engagement of the locking and receiving means to allow coupling of the first and second plurality of accessory teeth independent of function of the locking and receiving means.

9. A coupling apparatus as defined in claim 1 wherein the interconnecting coupling comprises an internally threaded ring having a shoulder engaging a lip on the second connecting element and external threads on the body of the first connecting element.

10. A coupling apparatus as defined in claim 9 wherein the ring is unperforated.

11. A coupling apparatus as defined in claim 1 wherein the apex angle of the at least one indexing tooth is about 30 degrees.

12. A coupling apparatus as defined in claim 11 wherein engagement of the at least one indexing tooth with an oppositely adjacent one of the accessory teeth self aligns the coupling elements.

13. A coupling apparatus as defined in claim 1 wherein the at least one indexing tooth has an apex with a radius of about 0.010 to 0.015 inch.

14. A coupling apparatus as defined in claim 13 wherein the first and second plurality of accessory teeth each have an apex with a radius of about 0.010 to 0.015 inch.

15. A coupling apparatus as defined in claim 14 wherein peak to peak engagement of the at least one indexing tooth apex and the apex of an oppositely adjacent one of the accessory teeth precludes binding.

16. A method for creating a self-aligning non-binding coupling comprising the steps of:

configuring a first connecting element with a first set of accessory teeth including at least one indexing tooth having a reduced apex angle and greater length than the remaining teeth in the set;

configuring a second connecting element with a second set of accessory teeth complimentary to the first set and having means to receive the at least one indexing tooth;

engaging the first and second connecting element with a coupling ring;

drawing the first and second connecting elements together using the coupling ring;

engaging an opposing tooth in the second set of accessory teeth with the indexing tooth, said reduced apex angle deflecting the index tooth into the adjacent receiving means to align the first and second sets of accessory teeth.

17. A method as defined in claim 16 wherein the step of configuring the first connecting element with a first set of accessory teeth includes providing two indexing teeth spaced at 180 degrees.

18. A method as defined in claim 16 wherein the step of configuring the first connecting element with a first set of accessory teeth includes providing three indexing teeth spaced at 120 degrees.

* * * * *